US007571843B2

(12) United States Patent
Kumayama

(10) Patent No.: US 7,571,843 B2
(45) Date of Patent: Aug. 11, 2009

(54) STAPLE STORAGE CASSETTE AND CASSETTE TYPE STAPLER

(75) Inventor: Michihito Kumayama, Tokyo (JP)

(73) Assignee: Sebek Limited, Tokyo (JP)

( * ) Notice: Subject to any disclaimer, the term of this patent is extended or adjusted under 35 U.S.C. 154(b) by 131 days.

(21) Appl. No.: 11/909,729

(22) PCT Filed: Mar. 31, 2005

(86) PCT No.: PCT/JP2005/006261

§ 371 (c)(1),
(2), (4) Date: Sep. 26, 2007

(87) PCT Pub. No.: WO2006/106568

PCT Pub. Date: Oct. 12, 2006

(65) Prior Publication Data

US 2009/0014496 A1 Jan. 15, 2009

(51) Int. Cl.
*B25C 5/16* (2006.01)

(52) U.S. Cl. ..... 227/120; 227/127; 227/136

(58) Field of Classification Search ..... 227/120, 227/109, 119, 136, 131, 134, 127
See application file for complete search history.

(56) References Cited

U.S. PATENT DOCUMENTS 3,469,758 A * 9/1969 Volkmann ..... 227/120
4,199,095 A 4/1980 Yamanoi
4,524,896 A * 6/1985 Morrell, Jr. ..... 227/126
4,728,021 A * 3/1988 Kennedy ..... 227/120
4,801,062 A * 1/1989 Austin ..... 227/128
5,163,596 A * 11/1992 Ravoo et al. ..... 227/109
5,195,671 A * 3/1993 Shimomura et al. ..... 227/5
5,244,139 A * 9/1993 Joyce ..... 227/120
5,330,086 A * 7/1994 Shimomura et al. ..... 227/7
5,673,838 A * 10/1997 Reitze ..... 227/119
5,758,813 A * 6/1998 Kikuchi et al. ..... 227/155
6,082,604 A * 7/2000 Dennis ..... 227/8

(Continued)

FOREIGN PATENT DOCUMENTS

JP 5-56363 7/1993

(Continued)

OTHER PUBLICATIONS

English language International Search Report Form PCT/ISA/210 (second sheet) for PCT/JP2005/006261.

(Continued)

*Primary Examiner*—Scott A. Smith
(74) *Attorney, Agent, or Firm*—Staas & Halsey LLP

(57) ABSTRACT

A staple storage cassette, comprising a staple assembly slidably installed on a cassette rail member across a pair of guide rails vertically formed parallel with each other, a feeder slidably brought into contact with the rear end part of the staple assembly, and a cassette cover member forming a passage in which staples and the feeder are inserted. A stopper is installed and a blade guide hole is formed at the front end part of the cassette cover member, and engagement recessed parts engaged with the elastically engaged claw pieces of the feeder in one direction are continuously formed in the inner surface of the cassette cover member in the longitudinal direction so that the feeder can be moved in the forward direction only.

11 Claims, 15 Drawing Sheets

U.S. PATENT DOCUMENTS

| | | | | |
|---|---|---|---|---|
| 6,135,337 | A * | 10/2000 | Harris et al. | 227/131 |
| 6,557,744 | B2 * | 5/2003 | Kitamura | 227/119 |
| 6,595,399 | B1 | 7/2003 | Cassese | |

FOREIGN PATENT DOCUMENTS

| | | |
|---|---|---|
| JP | 7-96475 | 4/1995 |
| JP | 11-129168 | 5/1999 |
| JP | 2002-337065 | 11/2002 |

OTHER PUBLICATIONS

PCT International Preliminary Report on Patentability for corresponding International Application No. PCT/JP2005/006261) mailed Nov. 29, 2007.

* cited by examiner

PRIOR ART

PRIOR ART

STAPLE STORAGE CASSETTE AND CASSETTE TYPE STAPLER

TECHNICAL FIELD

The present invention relates to a staple storage cassette which accommodates a staple assembly composed of a plurality of substantially U-shaped staples connected in succession and a cassette type stapler having a cassette loading magazine loaded with this staple storage cassette.

BACKGROUND ART

Conventionally, the stapler in which a substantially U-shaped staple is driven into plural pieces of papers or the like and then the lower end portion of the staple is bent so as to bind the papers or the like has taken an important role in office work and other operations.

Handling of the staples for use in the conventional stapler is largely divided into a type in which the staple assembly composed of a plurality of substantially U-shaped staples connected in succession is accommodated directly within a magazine for usage and a type in which the staple storage cassette accommodating the staple assembly is loaded on the cassette loading magazine of the stapler. The former is often used for a portable small size stapler and the latter is often used for a large size stapler for office work.

As methods for forwarding the staple assembly within the staple storage cassette to a staple punch-out side, there are method in which a feeder abutting the rear end portion of the staple assembly is pressed by a compression spring to push the staple assembly to the punch-out side and a method in which the feeder is pulled by a tension spring from the staple punch-out side to push the staple assembly to the punch-out side. As another method, a method in which the staple assembly is introduced to the punch-out side with magnetic force of a magnet provided on the front end portion of the staple storage cassette has been used.

FIG. 14 shows an example of the staple storage cassette for use in a conventional cassette type stapler for office use.

FIG. 14 is a plan view of a condition in which the cassette cover of the staple storage cassette for use in the cassette type stapler for office use is removed.

In the cassette type stapler which uses the staple storage cassette 130 as shown in FIG. 14, a pusher 133 abuts the rear end portion of a staple assembly 132 accommodated in a cassette body 131 of a staple storage cassette 130. The staple assembly 132 is pushed in a forward direction by a pressing force of a compression spring 136 inserted into and supported by a rod 135 supported by a rear portion wall 134 of the cassette body 131 through the pusher 133. Then, a staple 137 at the head of the staple assembly 132 pushed to the punch-out side is configured to be driven out downward passing through a blade guide hole 138 by a staple pushing blade (not shown) (see for example, Patent Document 1).

FIG. 15 is a longitudinal sectional view of the cassette type stapler for office use which uses the staple storage cassette shown in FIG. 14.

The cassette type stapler 140 for office use comprises a horizontal base 141 having an anvil block 142 for guiding the bending of the bottom end portions of a staple, a loading portion pivot shaft member 143 provided on the horizontal base 141, a cassette loading magazine 144 supported by the loading portion pivot shaft member 143, a handle portion pivot shaft member 145 provided on the cassette loading magazine 144 and a push-down handle portion 146 supported by the handle portion pivot shaft member 145. A magazine supporting spring 147 is provided between the horizontal base 141 and the cassette loading magazine 144 and a handle supporting spring 148 is provided between the cassette loading magazine 144 and the push-down handle portion 146.

The staple storage cassette (not shown) loaded with the staple assembly composed of a plurality of the staples connected in succession can be inserted detachably into the cassette loading magazine 144. A blade passage 149 is provided at an one end portion of the cassette loading magazine 144 and a staple pushing blade 150 which can descend through the blade passage 149 is coupled with the push-down handle portion 146 (see, for example, Patent Document 2).

Patent Document 1: Japanese Patent Laid-Open Publication No. H07-96475

Patent Document 2: Japanese Patent Laid-Open Publication No. 2002-337065

DISCLOSURE OF THE INVENTION

Problem to be Solved by the Invention

However, in the above-described conventional cassette type stapler, a compression spring for pushing the pusher in order to forward the staple into the cassette body of the staple storage cassette is accommodated and therefore, a large space for which this spring occupies is needed. As a result, the quantity of staples which can be accommodated within the cassette body of the staple storage cassette is decreased.

To increase the quantity of staples to be stored, there are two ways, increasing the length of the cassette or decreasing the thickness of the staple. However, the former method cannot reduce the size of the stapler and the latter method cannot allow the quantity of staples to be increased due to limitation of the strength of the staple.

Accordingly, an object of the present invention is to provide a staple storage cassette capable of increasing the quantity of staples which can be accommodated even if the size thereof is the same as a conventional one and a cassette type stapler capable of using the staple storage cassette accommodating more staples.

Another object of the invention is to provide an environmental friendly staple storage cassette which facilitates the treatment after use of staple storage cassettes which are regarded as consumable supplies.

Means for Solving the Problem

In order to achieve the above-mentioned object, according to the invention described in a first aspect of the invention, there is provided a staple storage cassette including: a cassette rail member having a pair of guide rails disposed in parallel with a gap therebetween; a staple assembly including a plurality of staples connected in succession, slidably movable on the cassette rail member; a feeder which makes contact with the rear end portion of the staple assembly and slidably movable on the cassette rail member; and a cassette cover member which covers at least both side surfaces in the longitudinal direction and a top surface of the cassette rail member so as to form a passage into which the staple and the feeder are inserted, wherein the cassette cover member has a stopper for positioning a head position of the staple assembly at a front end portion thereof and a blade guide hole through which a staple pushing blade passes, the blade guide hole being located adjacent to the stopper, the feeder includes an elastically engaged claw piece, an engaging concave portion which engages the elastically engaged claw piece only in one direction is formed continuously in the longitudinal direction in the inner surface of the cassette cover member so as to allow the feeder to move only in a forward direction.

A second aspect of the invention in addition to the configuration described in the first aspect of the invention, is characterized in that the cassette rail member and the cassette cover member are detachably integrated.

A third aspect of the invention is characterized in that a cassette type stapler having a cassette loading magazine on which the staple storage cassette according to the first or second aspect is loaded, wherein the cassette loading magazine has a pusher which makes contact with the rear end portion of the feeder after the staple storage cassette is loaded and a driving unit for moving the pusher toward the blade guide hole.

A fourth aspect of the invention in addition to the configuration of the third aspect, is characterized in that the driving unit includes: a traction string one end of which is fixed to the pusher; an elastic member which generates a traction force in the traction string attached to the cassette loading magazine; and an intermediating block for connecting the elastic member with the other end of the traction string, a first fixed pulley and a second fixed pulley are pivoted independently on a front portion of the cassette loading magazine, a movable pulley is pivoted by the intermediating block, the traction string is connected to the intermediating block through the first fixed pulley, the movable pulley and the second fixed pulley, and the traction force toward the blade guide hole is always applied to the pusher.

A fifth aspect of the invention is characterized by further comprising a pusher holding unit in which when the staple storage cassette is pulled out and not loaded on the cassette loading magazine, the pusher is held at the rear end portion of the cassette loading magazine and when the staple storage cassette is loaded on the cassette loading magazine, holding of the pusher at the rear end portion of the cassette loading magazine is released.

A sixth aspect of the invention in addition to the configuration described in any one of the third to fifth aspects, is characterized in that a metallic staple guide member having a substantially U-shaped in transverse section is disposed at a front end portion of the cassette loading magazine and when the staple storage cassette is loaded on the cassette loading magazine, outer side surfaces of foot portions of at least a staple at the head of the staple assembly are guided by the opposing both side walls of the staple guide member so as to descend the staple.

EFFECT OF THE INVENTION

As described above, according to the invention described in the first aspect, only the staple assembly and the feeder are disposed on the cassette rail member and the driving unit for pressing the feeder in the forward direction is provided independently of the staple storage cassette. Consequently, when the staple storage cassette is formed in the same size as of a conventional one, more staples can be accommodated. If the same quantity of the staples as of a conventional one is accommodated, the staple storage cassette can be formed small in size and light in weight.

Further because no metallic components such as a compression spring are used as the driving unit for pressing the feeder in the forward direction in the staple storage cassette, the cassette body having the cassette rail member, feeder and cassette cover member, which constitute the staple storage cassette, can be formed of plastic material, paper or the like. Therefore, there is provided an environmental-friendly staple storage cassette which does not need segregation work for disposal after the staples are consumed, thereby facilitating the disposal processing and enabling reuse as a resource.

According to the invention described in the second aspect, because the cassette body having the cassette rail member and the cassette cover member can be easily assembled or disassembled, the assembly work of building the staple assembly and feeder onto the staple storage cassette and the disassembly work of removing the feeder from the staple storage cassette are facilitated. In addition to the effect described in the first aspect, labor and time can be reduced to save cost in not only manufacturing anew staple storage cassette but also reusing the staple storage cassette loaded with a new staple assembly or reusing thereof as a resource for a new product in case of disposal processing.

According to the invention described in the third aspect, a stapler capable of binding papers or the like using the small and light staple storage cassette described in the first or second aspect is obtained.

According to the invention described in the fourth aspect, a compact pulley mechanism comprised of the traction string, the fixed pulleys and the movable pulley is adopted in the cassette loading magazine and an end of the traction string is connected to the pusher while the other end is connected to the intermediating block. Further, the movable pulley is supported by the intermediating block and the elastic member mounted on the cassette loading magazine is attached to the intermediating block. Thus, in addition to the effect described in the third aspect, a deformation amount of the elastic member can be set below a maximum moving distance of the pusher. Therefore, the entire driving unit for moving the pusher can be built in the cassette loading magazine of substantially the same size as the staple storage cassette, thereby providing a small size stapler.

According to the invention described in the fifth aspect, when the staple storage cassette is pulled out and not loaded on the cassette loading magazine, the pusher is held at a predetermined position and when the staple storage cassette is inserted into and mounted on the cassette loading magazine, the holding of the pusher is released so that the pusher is brought into contact with the rear end portion of the feeder by an action of the driving unit so as to forward the staple assembly. Thus, in addition to the effect described in the third or fourth aspect, by insertion and pulling out of the staple storage cassette into/from the cassette loading magazine, holding of the pusher is automatically released from the predetermined position and holding of the pusher at the predetermined position can be automatically achieved. Therefore, the staple storage cassette can be used repeatedly without any special operation other than insertion and pulling out thereby, a highly reliable stapler easy to use and unlikely to be operated mistakenly can be provided.

According to the invention described in the sixth aspect, the outer side surfaces of the foot portions of the staple at the head of the staple assembly are covered by both side walls of the metallic staple guide member. As a result, even if phenomenon such as inclination of the foot portion of the staple occurs in driving the staple into paper or the like, the staple is guided with the foot portion thereof kept in a perpendicular direction by the staple guide member and in addition to the effect described in any one of the third to fifth aspects, such a fault as an error of driving into papers or the like due to inclination of the staple and failure of driving into papers or the like can be prevented.

BEST MODE FOR CARRYING OUT THE INVENTION

Hereinafter, the embodiments of the staple storage cassette of the present invention will be described in detail.

Figure 1:
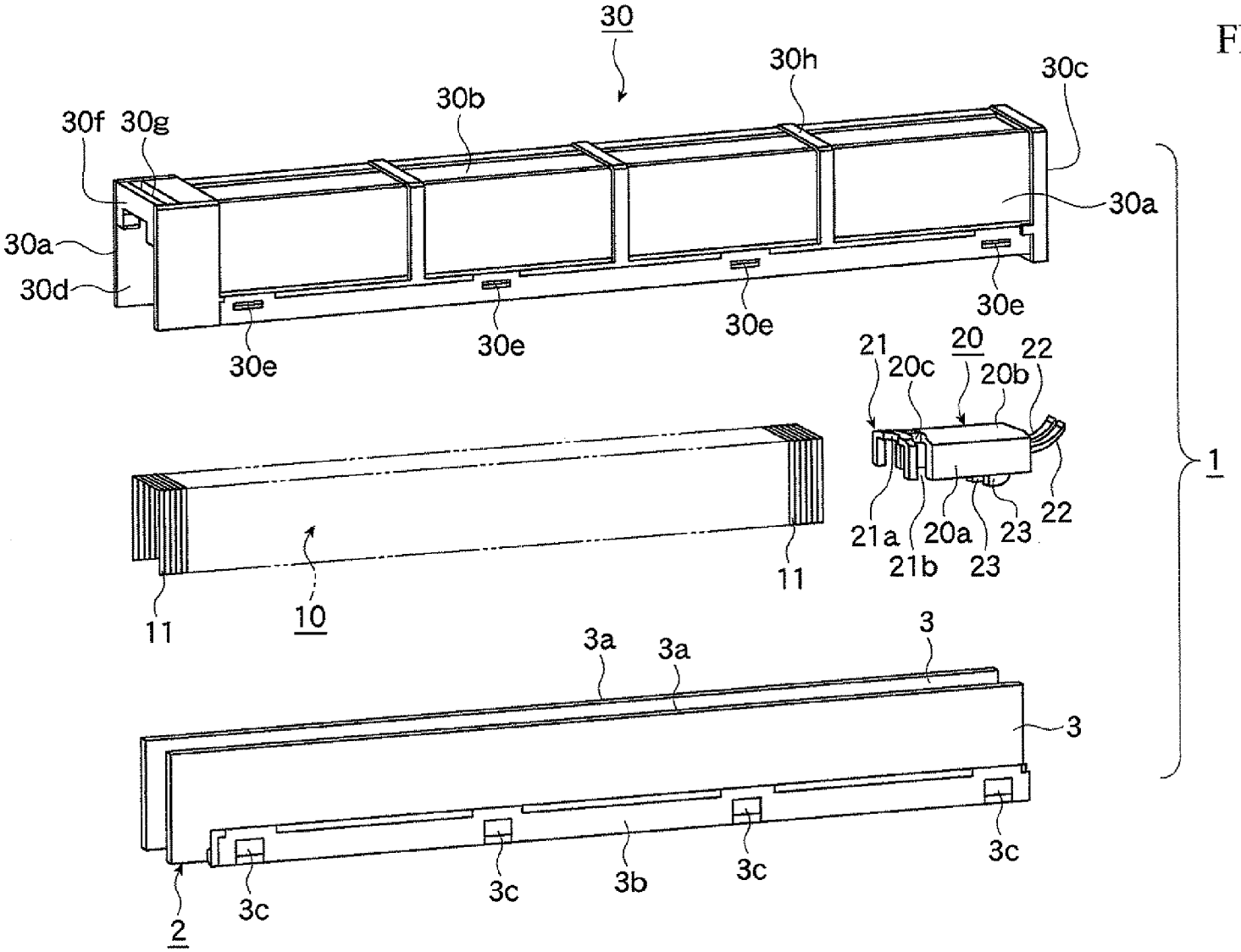
FIG. 1 is an exploded perspective view showing an embodiment of the staple storage cassette of the present invention.
Figure 2:
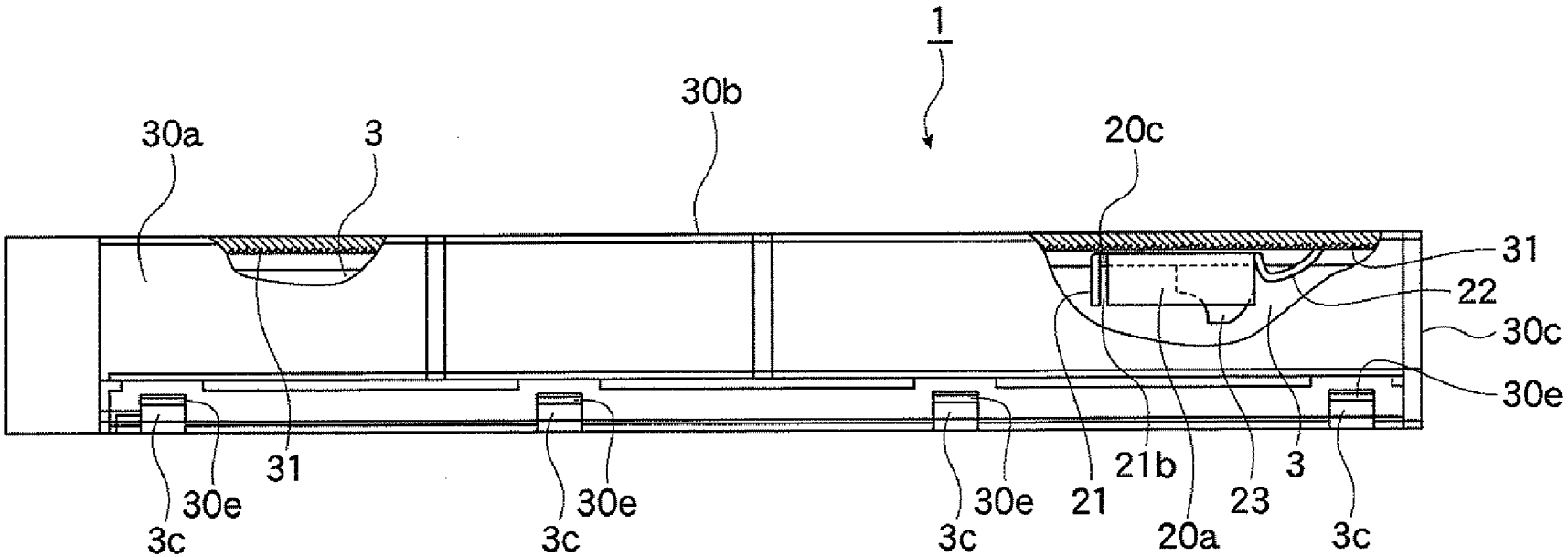
FIG. 2 is a partially broken front view of the same embodiment.

FIG. 1 is an exploded perspective view showing the embodiment of the staple storage cassette of the present invention. FIG. 2 is a partially broken front view showing the embodiment of the staple storage cassette of the present invention.

The staple storage cassette 1 is a component which accommodates and stores a staple assembly 10 composed of a plurality of substantially U-shaped staples 11 connected in succession and is to be mounted on a cassette loading magazine 40 of the cassette type stapler 110 described later so as to drive out a staple 11.

The staple storage cassette 1 has a cassette rail member 2 composed of a pair of guide rails 3, 3 disposed in parallel with a gap therebetween and a staple assembly 10 composed of a plurality of staples 11 connected in succession are disposed slidably in the longitudinal direction between rail surfaces 3*a*, 3*a* of the cassette rail member 2. A feeder 20 which makes contact with the rear end portion of the staple assembly 10 to press the staple assembly 10 in a forward direction (drive out side) of the staple 11 is disposed slidably between the rail surfaces 3*a*, 3*a* of the cassette rail member 2.

The cassette cover member 30 has both side walls 30*a*, 30*a* and top plate 30*b* for covering at least three sides, namely, both side surfaces in the longitudinal direction of the cassette rail member 2 and the longitudinal direction of the top plate, providing a substantially U-shaped section and a blind rear wall 30*c* is formed integrally at the rear end portion.

Belt-like bent pieces 3*b*, 3*b* are projected substantially throughout the entire length of the lower end portions of both side in the longitudinal direction of the cassette rail member 2. This belt-like bent piece 3*b* is formed thinner than other portions of the cassette rail member 2 and has a plurality of fitting holes 3*c* which are fit to a plurality of fitting convex portions 30*e* formed on the bottom end portion of both sides of the cassette cover member 30. Because the belt-like bent pieces 3*b* are deformable due to an elastic restoration force, the cassette cover member 30 can be easily attached to/detached from the cassette rail member 2. That is, the cassette rail member 2 and the cassette cover member 30 are fixed detachably so as to facilitate assembly and disassembly.

A plurality of reinforcement ribs 30*h* are formed appropriately on the outer peripheral surface of the cassette cover member 30.

The cassette cover member 30 is provided with a stopper 30*f* at its front end portion in order to prevent the staple assembly 10 pressed in the forward direction of the staple 11 by a feeder 20 from dropping off. The stopper 30*f* is of a substantially U-shaped thin plate of a size capable of pressing the upper half portion of the substantially U-shaped staple 11. Further, a slit-like blade guide hole 30*g* is provided along a vertical direction in the top plate 30*b* adjacent to this stopper 30*f* to allow a staple pushing blade 118 described later to pass through.

As shown in FIG. 2, a saw tooth like engaging concave portion 31 is formed substantially throughout the entire length in the longitudinal direction of the bottom surface of the top plate 30*b*. In this engaging concave portion 31, inclining surfaces which incline downward in the forward direction of the staple 11 and vertical surfaces are formed alternately. In this engaging concave portion 31, the elastically engaged claw piece 22 of the feeder 20 disposed across the cassette rail members 2 engages only with the vertical surface, but does not engage with the inclining surface, so that it engages only in a single direction. Therefore, the feeder 20 cannot be moved in the backward direction although it is slidably movable in the forward direction.

In the feeder 20, both the side walls 20*a*, 20*b* and the top plate 20*b* are formed integrally of synthetic resin material so that a lateral sectional shape whose opening is directed downward is formed in a substantially U shape. A circular or V-shaped concave portion 21*a* is formed at the front end portion of the top plate 20*b* of this feeder 20. A slit 21*b* is formed in the vicinity of the front end portion of the top plate 20*b* and both the side walls 20*a*, 20*b* of the feeder 20 such that the slit goes through with a connecting piece 20*c* left in the central portion and a shock absorbing portion 21 capable of swinging freely is formed by the connecting piece 20*c*. The elastically engaged claw pieces 22 are formed integrally at the rear end portion of the top plate 20*b* of the feeder 20 such that it extends backward while projecting and curved upward of the top surface of the top plate 20*b* of the feeder 20. The front end portion of the elastically engaged claw piece 22 is formed sharp to engage only the engaging concave portion 31 of the cassette cover member 30 only in a single direction. Two fish-fin like locking fins 23, 23 are provided in a parallel spaced relation from a substantially intermediate portion in the longitudinal direction toward the rear end such that they are projected slightly downward from the side walls 20*a* of the feeder 20.

Next, the cassette type stapler into which the staple storage cassette described in FIG. 1 and FIG. 2 is loaded will be described with reference to FIG. 3-FIG. 12.

Figure 3:
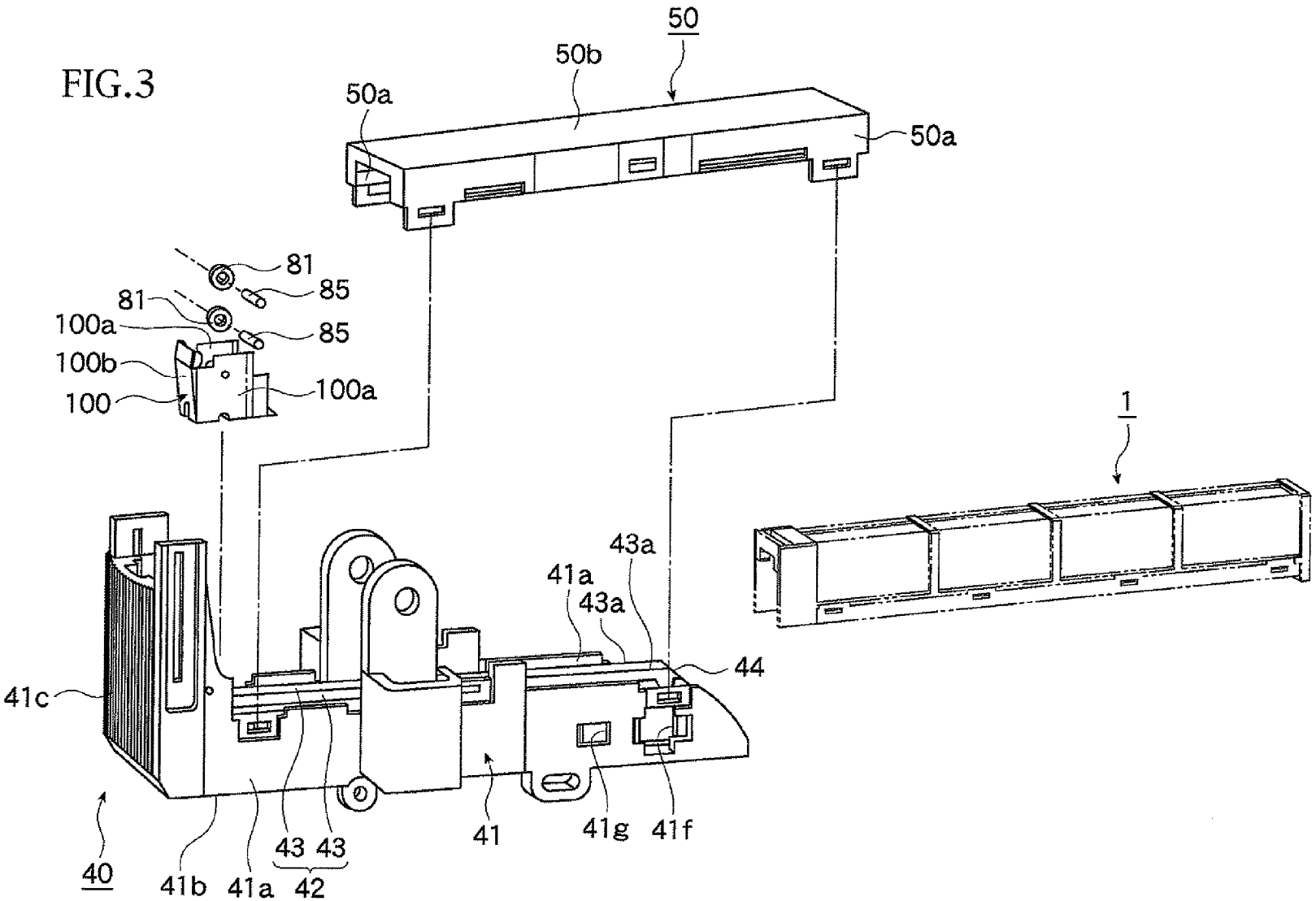
FIG. 3 is an exploded perspective view of the embodiment of the cassette loading magazine which is a component of the cassette type stapler of the present invention.

FIG. 3 is an exploded perspective view of the cassette loading magazine which can be loaded with the staple storage cassette.

The cassette loading magazine 40 into which the staple storage cassette 1 can be loaded, is formed integrally of both side walls 41*a*, 41*a*, a bottom plate 41*b* and a front wall section 41*c* as shown in FIG. 3. Two rail guide plates 43, 43 are disposed at spacing intervals in parallel to the both side walls 41*a*, 41*a* inside the both side walls 41*a*, 41*a* so that they are formed on the bottom plate 41*b* so as to form a magazine rail member 42. A magazine cover member 50 is attached detachably to the magazine rail member 42 so as to cover an entire upper opening portion of the magazine rail member 42 thereby facilitating assembly and inspection. A cassette insertion port 44 is provided at the rear of the magazine rail member 42 so that the staple storage cassette 1 can be inserted/removed.

A front wall section 41*c* extending upward is provided on the front portions of the both side walls 41*a*, 41*a* of the cassette loading magazine 40 and a front end portion of the staple storage cassette 1 makes contact with the inside surface of this front wall section 41*c*, thereby exerting a function of positioning the staple storage cassette 1. A blade guide groove (not shown) for guiding the staple pushing blade 118 for pushing a staple 11 at the head of the staple assembly 10 is formed in the inner surface of the front wall section 41*c* and a slit-like blade guide hole 41*d* is provided in the bottom plate 41*b* just below the blade guide hole (see FIG. 7).

A driving unit 70 for moving the feeder 20 which makes contact with the rear end portion of the staple assembly 10 within the staple storage cassette 1 and presses the staple assembly 10 in the forward direction is incorporated between the two rail guide plates 43 and 43 of the cassette loading magazine 40.

A metallic staple guide member 100 formed into a substantially U shape in its transverse section of the both side walls 100*a*, 100*a* and the front wall section 100*b* is mounted at the front end portion which is a driven-out side of the staple 11 of the cassette loading magazine 40.

When the staple storage cassette 1 is loaded on the cassette loading magazine 40, the both side walls 100*a*, 100*a* of the staple guide member 100 invades in between the outer side surfaces of the feet portions of some staples 11, 11, 11, . . . including the staple 11 at the head of the staple assembly 10 disposed on the cassette rail member 2 within the staple storage cassette 1 and the inner wall surface of the both side walls 30*a*, 30*a* of the cassette cover member 30, so that the inner wall surfaces of the both side walls 30*a*, 30*a* of the cassette cover member 30 do not make direct contact with the staple 11. Consequently, even if a force which inclines the foot portion of the staple 11 in the transverse direction is applied, the staple 11 is guided by the both side walls 100*a*, 100*a* of the staple guide member 100 and thus, the inner wall surfaces of the both side walls 30*a*, 30*a* of the cassette cover member 30 are never scraped by the staple 11. Further, the feet of the staples 11 never bite into the both side walls 30*a*, 30*a* of the cassette cover member 30, so that no staple 11 is jammed, preventing such failure from occurring.

Figure 4:
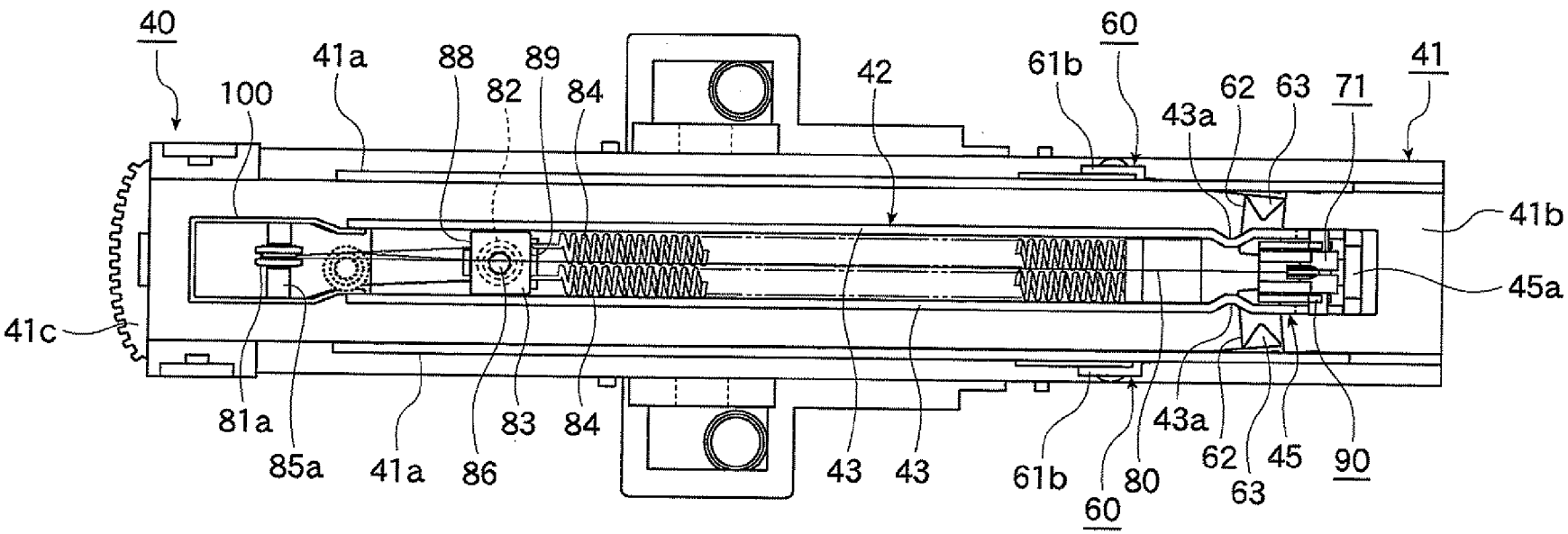
FIG. 4 is a plan view of a condition in which the magazine cover member of the embodiment of the cassette loading magazine is removed.
Figure 5:
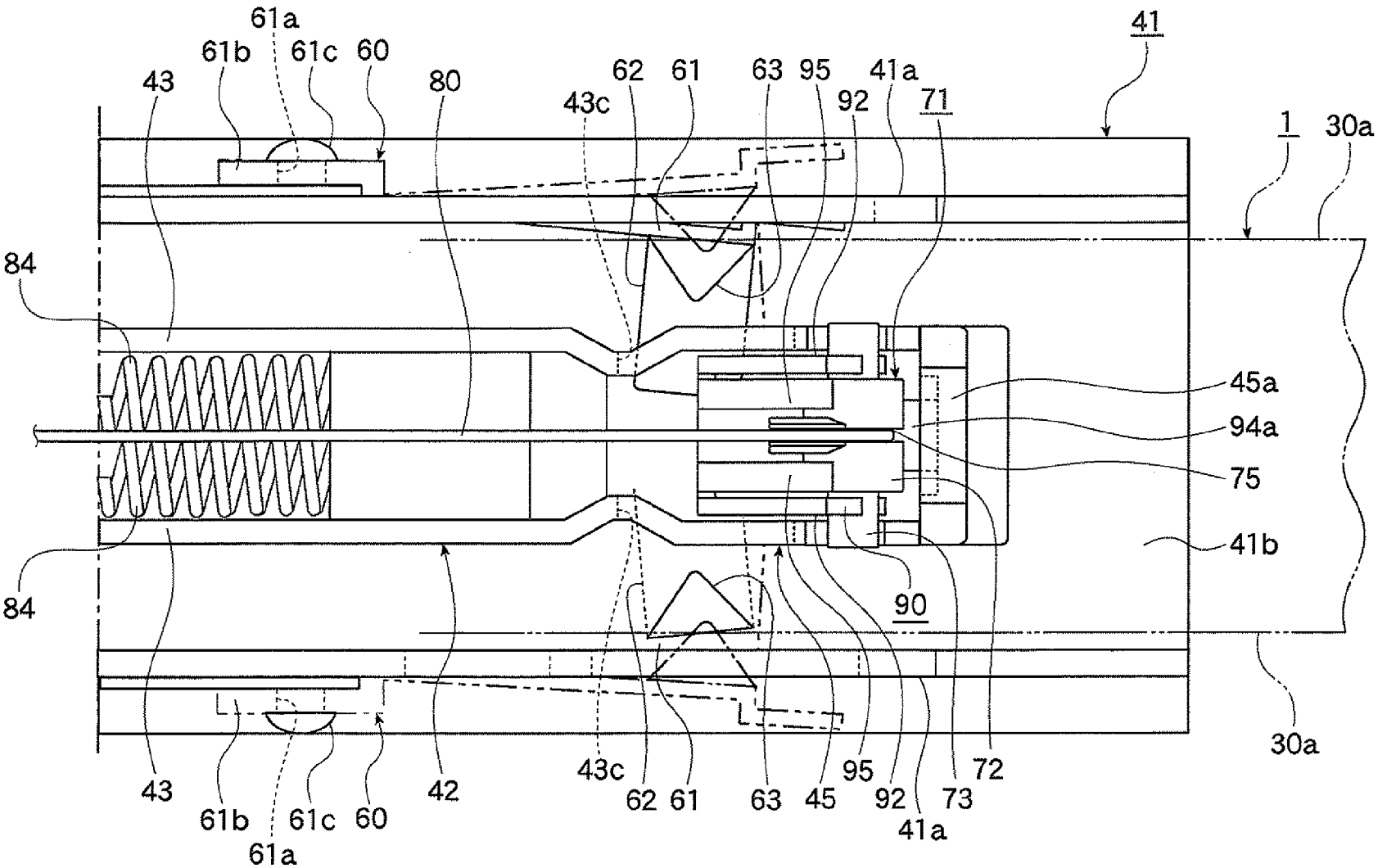
FIG. 5 is an enlarged plan view showing the vicinity of an accommodating portion of the embodiment of the cassette loading magazine.
Figure 6:
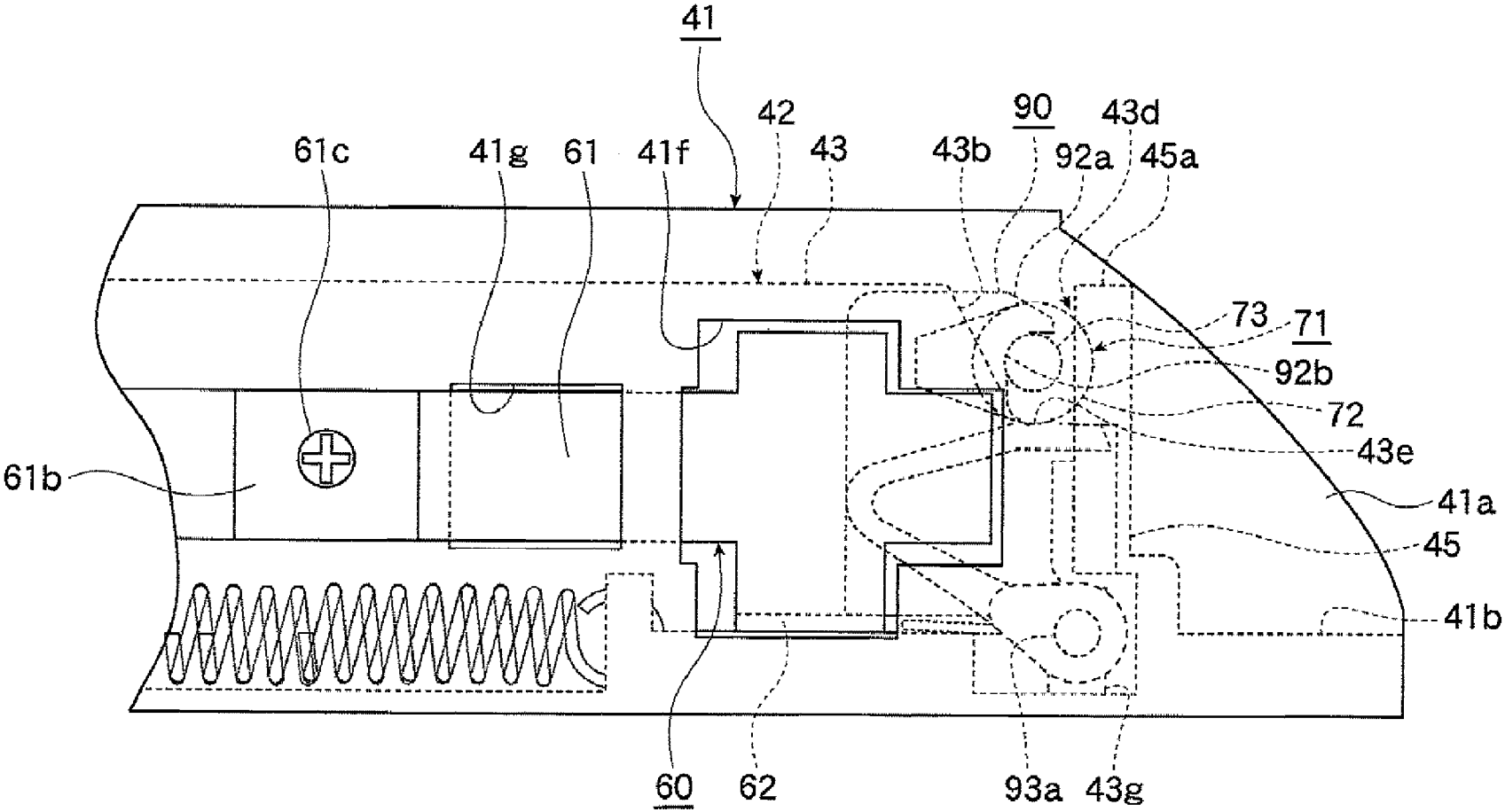
FIG. 6 is an enlarged front view showing the vicinity of the accommodating portion of the embodiment of the cassette loading magazine.

FIG. 4 is a plan view of a condition in which the magazine cover member of the embodiment of the cassette loading magazine is removed. FIG. 5 is an enlarged plan view showing the vicinity of an accommodating portion of the cassette loading magazine. FIG. 6 is an enlarged front view showing the vicinity of the accommodating portion of the cassette loading magazine.

An accommodating portion 45 in which a pusher holding unit 90 is disposed is formed at the rear end portions of the two rail guide plates 43, 43. Concave portions 43*a*, 43*a* which are bent inward are formed near the front portion of the accommodating portion 45 of the two rail guide plates 43, 43.

As shown in FIG. 6, a bearing portion 43*d* which is substantially V shaped in its front view, constituted of an inclining surface 43*b* extending downward toward the rear end portion, a horizontal surface 43*e* formed on the lower end portion of the inclining surface 43*b* and a guide wall section 45*a* provided vertically upward from the horizontal surface 43*e*, is formed above the rear end portion of the two guide rail plates 43, 43.

A substantially rectangular first opening portion 41*f* is formed in each of the both side walls 41*a*, 41*a* of the magazine body 41 and a second opening portion 41*g* which is smaller than the first opening portion 41*f* is adjacently formed in the forward direction of the first opening portion 41*f*.

The first opening portion 41*f* and the second opening portion 41*g* provided in the both side walls 41*a*, 41*a* of the magazine body 41 are used for positioning of and achieving an operation of a second lock spring 60, which has a fixing portion 61*b* having a bored mounting hole 61*a* at an one end portion of an elastically deformable narrow arm piece 61 while having, at the other free end side 64, an engaging piece 62 extending horizontally and a triangular pole-like releasing projection piece 63 provided upward from the engaging piece 62. That is, with the arm piece 61 of the second lock spring 60 passed through the second opening 41*g*, the fixing portion 61*b* is attached to the outside of the both side walls 41*a*, 41*a* of the magazine body 41 and fixed to the both side walls 41*a*, 41*a* of the magazine body 41 with a mounting screw 61*c* passing through the mounting hole 61*a*.

According to this structure, the engaging pieces 62 of the second lock springs 60 are always urged inward of the magazine rail members 42 such that they invade into the first opening portions 41*f* of the both side walls 41*a*, 41*a* of the magazine body 41 and through holes 43*c* in the lower portions of the accommodating portions 45 of the two rail guide plates 43, 43, so that they invade into a place below the pusher holding unit 90.

When the staple storage cassette 1 is not loaded on the cassette loading magazine 40, the engaging piece 62 of the second lock spring 60 invades into the place below the pusher holding unit 90, so that the pusher holding unit 90 is maintained in a standup attitude. As indicated with two-dot and dash line of FIG. 5, when the opposing releasing projection pieces 63, 63 are expanded outward in the horizontal direction by the front end angle portion and the both side walls 30*a*, 30*a* of the staple storage cassette 1, the engaging pieces 62 of the second lock springs 60 escape from the place below the pusher holding unit 90, so that the pusher holding unit 90 is capable of rotating in counterclockwise direction in FIG. 6 around a supporting shaft 93*a*.

Next, the driving unit will be described with reference to FIG. 7-FIG. 12.

Figure 7:
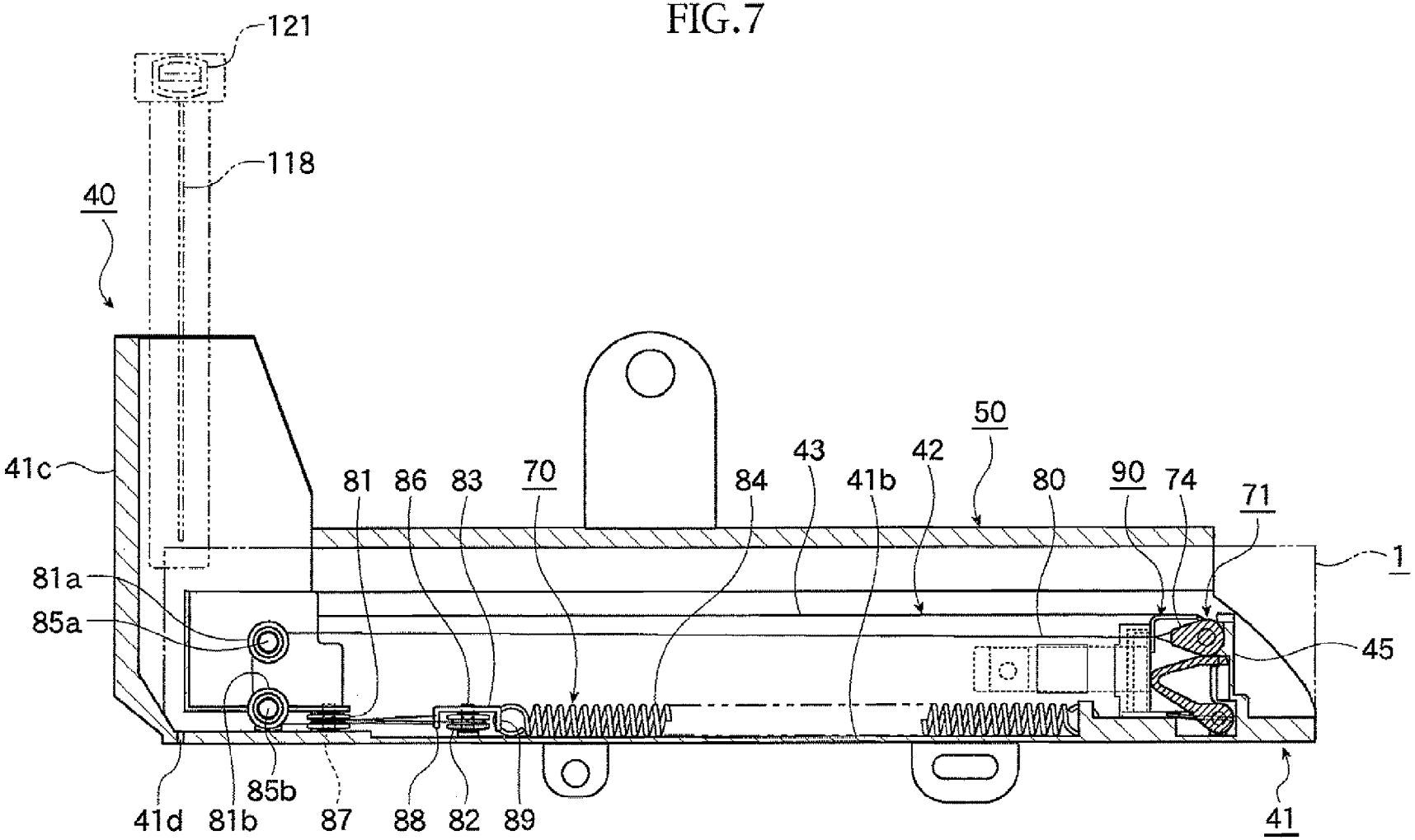
FIG. 7 is a longitudinal sectional view of the embodiment of the cassette loading magazine.

FIG. 7 is a longitudinal sectional view of the cassette loading magazine.

In the driving unit 70, the pusher 71 is brought into contact with the rear portions of the two locking fins 23, 23 formed such that they project downward from the feeder 20 and the feeder 20 is pulled with a traction string 80 connected to the pusher 71 so as to move the staple assembly 10 toward the staple pushing blade 118.

One end portion of the traction string 80 is connected with the pusher 71. The other end portion of the traction string 80 passes through a first fixed pulley 81*a* supported by a first supporting shaft 85*a* and a second fixed pulley 81*b* supported by a second supporting shaft 85*b*, disposed between the two rail guide plates 43, 43 near the front end of the magazine rail member 42 and is wound around a movable pulley 82 supported by a supporting shaft 86 fixed vertically to a movable intermediating block 83 located at an intermediate position of the magazine body 41 and then, is returned to a forward direction, and after wound around a fixed pulley 81 supported by a supporting shaft 87 fixed vertically to a bottom plate 41*b* of the front portion of the magazine body 41, returned to a backward direction again and finally is connected to a forward wall 88 of the intermediating block 83. The one end of a tension spring 84 is attached to a backward wall 89 of the intermediating block 83 and the other end portion of the tension spring 84 is hooked on a bottom plate 41*b* near the accommodating portion 45 placed at the rear portion of the magazine rail member 42.

Although in the indicated embodiment shown in the figures, an outward pathway and homeward pathway of the traction string 80 are prevented from interfering with each other by adopting the first fixed pulley 81*a* and the second fixed pulley 81*b* arranged vertically near the front side of the magazine rail member 42, the present invention is not limited to this example, but it is permissible to adopt a single large-diameter fixed pulley instead of the first fixed pulley 81*a* and the second fixed pulley 81*b*. Although the tension spring 84 is used as a driving source of the driving unit 70 for moving the feeder 20 to press the staple assembly 10 in the forward direction, the tension spring 84 may be replaced with a compression spring. In this case, the compression spring is installed at an opposite position to an installation position of the tension spring 84.

The pusher 71 is comprised of a cylindrical pusher body 72 and supporting shafts 73 having a smaller diameter than the pusher body 72 projecting from both side surfaces along an axis of the pusher body 72. A sheet-like hooking piece 74 projecting in the forward direction of the pusher 71 from the pusher body 72 is provided. A mounting groove 75 is formed in the central portion of the pusher body 72 from the outer peripheral portion of the pusher body 72 toward the hooking piece 74. The traction string 80 of the driving unit 70 is wound around this mounting groove 75. The supporting shaft 73 of the pusher 71 is slidably movable on a rail surface 42*a* of the magazine rail member 42.

Figure 8:
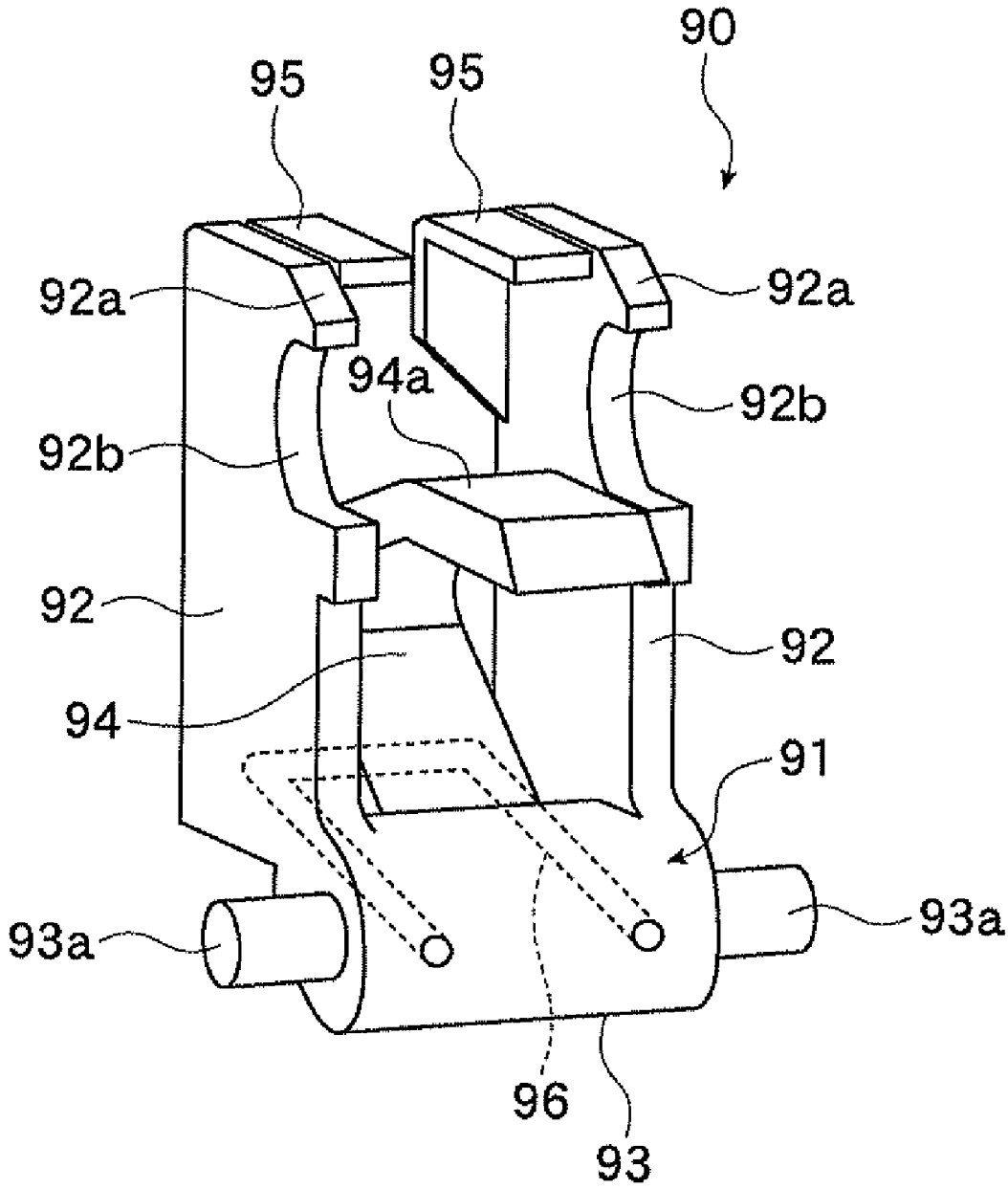
FIG. 8 is a perspective view showing the embodiment of the pusher holding unit which is a component of the cassette type stapler of the present invention.

FIG. 8 is a perspective view of a pusher holding unit for holding the pusher at a predetermined position temporarily.

The pusher holding unit 90 is provided with a body 91 in which the bottom portions of substantially rectangular plate engaging pieces 92, 92 disposed to oppose each other with its longitudinal direction set in a vertical direction are connected through a cylindrical connecting portion 93. From both ends of the connecting portion 93 of the main body 91, supporting shafts 93*a*, 93*a* are projected.

The supporting shafts 93*a* are supported rotatably by bearings 43*g* provided on the two rail guide plates 43, 43 near the rear end portion of the magazine rail member 42. As for the supporting shaft 93*a*, the bottom end portion of a sheet-like abutting engaging piece 94 having a substantially V-shape rotated by 90 degrees to the right in front view with its top portion substantially horizontal is fixed to the connecting portion 93. An inclining surface 92*a* descending toward the guide wall section 45*a* is formed on the top surface of the engaging piece 92 and an engaging concave portion 92*b* with which the supporting shaft 73 of the pusher 71 engages is formed below the inclining surface 92*a*.

An opening portion of the engaging concave portion 92*b* is directed to the guide wall section 45*a* and the top and bottom portions of the inner surface of the engaging concave portion 92*b* are formed substantially horizontal. A substantially L-shaped sensor piece 95 comprised of a fixing portion and a movable portion are provided on the top inside portion of each of the engaging pieces 92. The horizontal surface which is a movable portion of the sensor piece 95 is flush with the top surface of the engaging piece 92.

The one end portions of a lower wire spring 96 substantially U-shaped in its plan view are fixed to the connecting portion 93 of the pusher holding unit 90 while the free end which is the other end portion of the lower wire spring 96 extends substantially horizontally toward the staple pushing blade 118, making contact with the bottom plate 41*b* of the magazine body 41. Consequently, the pusher holding unit 90 is urged to be rotated in a clockwise direction in FIG. 6 around the supporting shaft 93*a*.

Next, an operation of the pusher holding unit will be described with reference to FIG. 9-FIG. 12.

Figure 9:
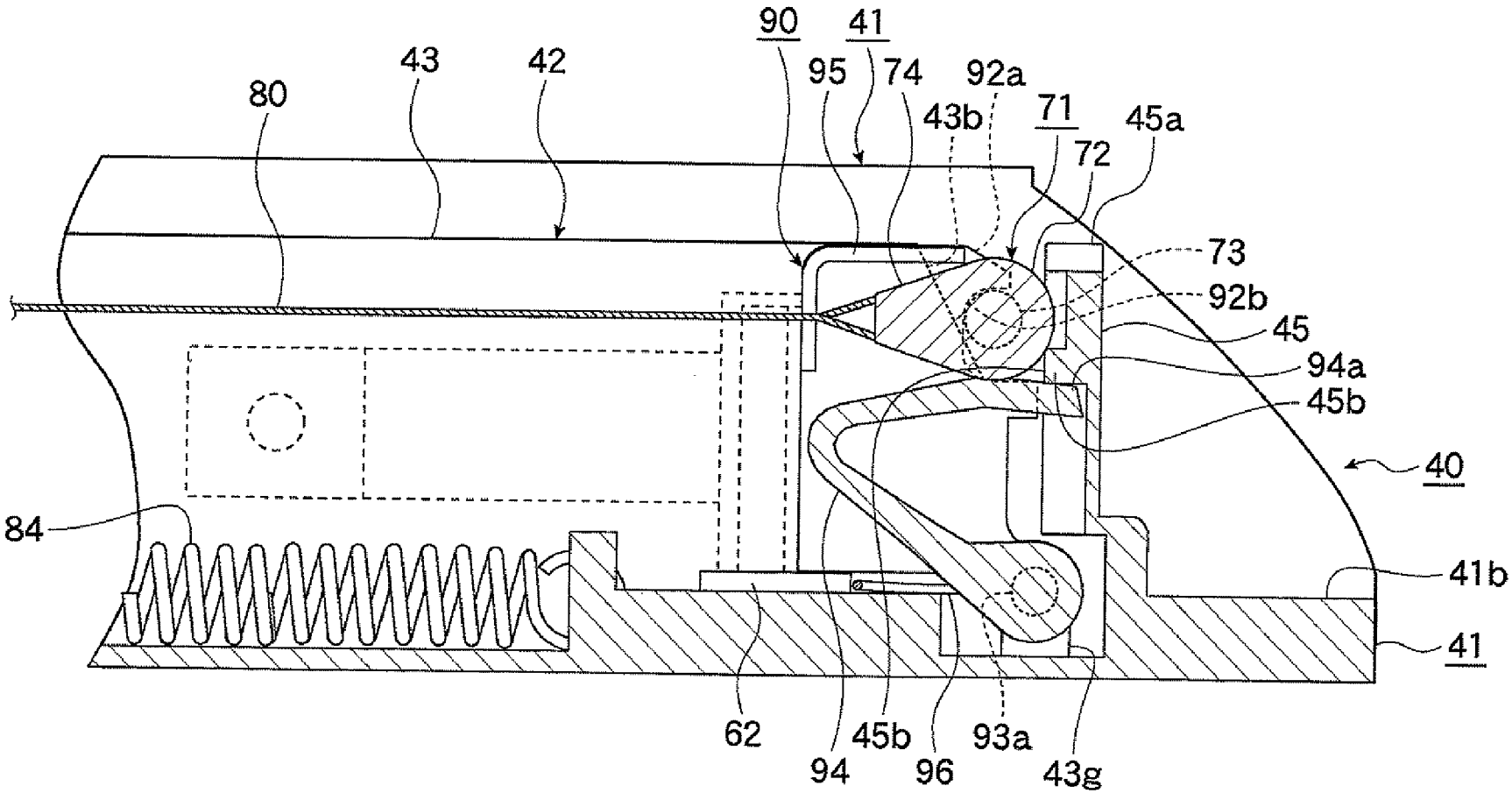
FIG. 9 is an enlarged front view of major portions showing a condition before the stapler storage cassette is loaded on the cassette type stapler of the embodiment of the present invention.

FIG. 9 is an enlarged front view of major portions of the cassette loading magazine showing a condition before the staple storage cassette is loaded.

When the staple storage cassette 1 is not loaded on the cassette loading magazine 40, the pusher holding unit 90 is in an upright condition and the supporting shaft 73 of the pusher 71 is engaged with the engaging concave portion 92*b* of the pusher holding unit 90. At this time, a top surface portion 94*a* at the front end of the abutting engaging piece 94 is engaged with the top portion of the inner surface of the engaging concave portion 45*b* in the guide wall section 45*a* of the accommodating portion 45 of the rear portion of the magazine rail member 42. That is, a rotation of the pusher holding unit 90 around the supporting shaft 93*a* is blocked by the abutting engaging piece 94 and the engaging piece 62.

Next, a case where the staple storage cassette 1 is loaded on the cassette loading magazine 40 will be described.

Figure 10:
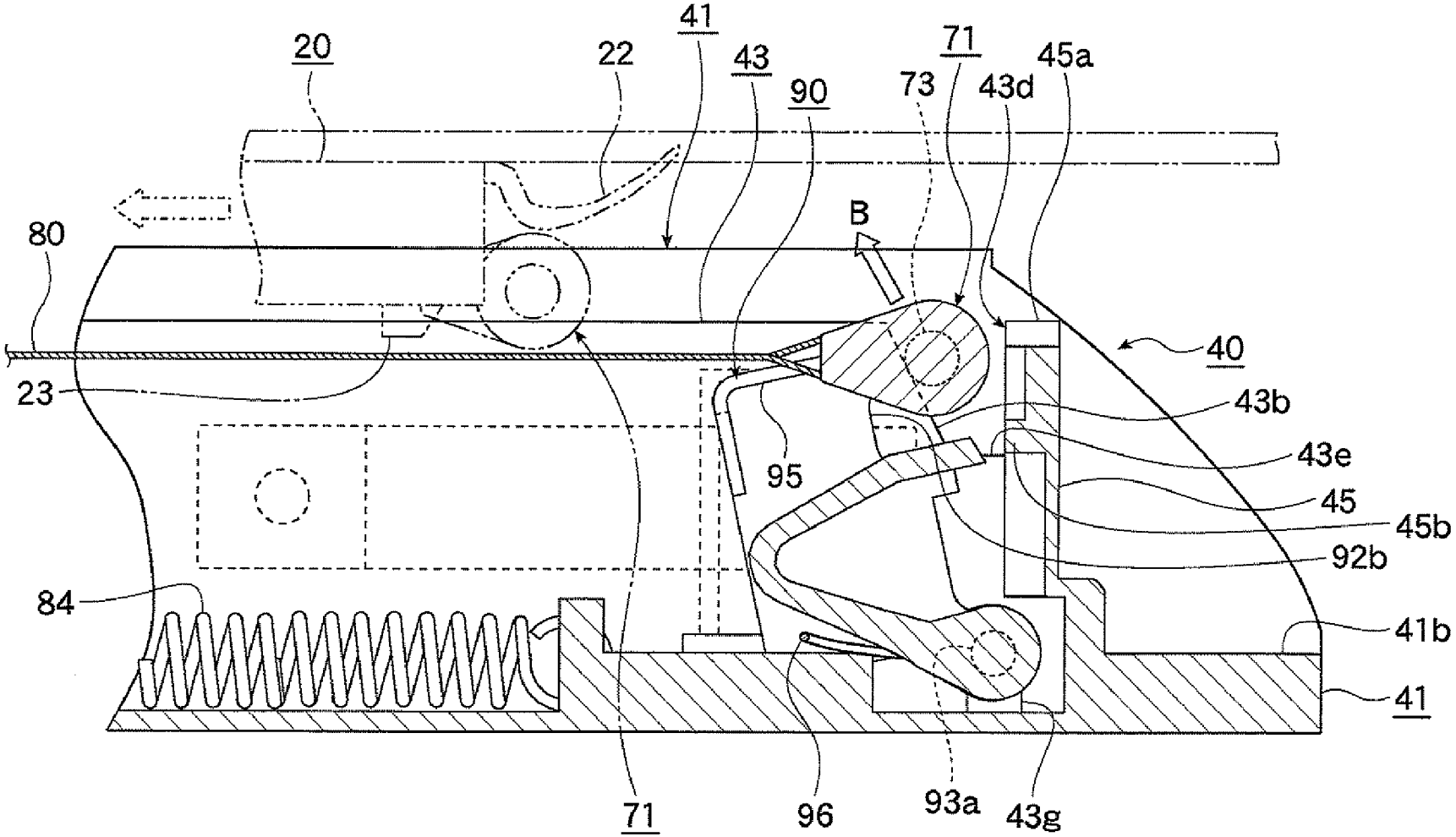
FIG. 10 is an enlarged front view of major portions showing a condition just after the staple storage cassette is inserted into the cassette type stapler of the embodiment.

FIG. 10 is an enlarged front view of major portions showing a condition just after the staple storage cassette is inserted.

When the staple storage cassette 1 is loaded on the cassette loading magazine 40, the releasing projection pieces 63, 63 opposing each other are expanded outwardly in the horizontal direction by the front end angle portion and the both side walls 30*a*, 30*a* of the staple storage cassette 1, so that the engaging pieces 62 located below the pusher holding unit 90 escape from the through holes 43*c* to release a first lock. Consequently, the pusher holding unit 90 is enabled to rotate in counterclockwise direction around the supporting shaft 93*a*, so that the horizontal surface 94*a* at the front end of the abutting engaging piece 94 engaged with the bottom surface portion of the engaging convex portion 45*b* of the guide wall section 45*a* is released and at the same time, the engaging concave portion 92*b* of the engaging piece 92 of the pusher holding unit 90 escape forward from the inclining surface 43*b* of the two rail guide plates 43, 43 and consequently, the supporting shaft 73 of the pusher 71 is unlocked from the engaging concave portion 92*b* and automatically escapes onto the inclining surface 43*b* of each of the two rail guide plates 43, 43. Then, the supporting shafts 73 slides upward on the inclining surface 43*b* of the two rail guide plates 43, 43 in a direction of an arrow B so that the pusher 71 makes contact with the rear end portion of the locking fin 23 of the feeder 20. At this time, as for the pusher 71 unlocked from the pusher holding unit 90, the pusher body 72 passes between the concave portions 43*a* and 43*a* opposing each other of the magazine rail member 42 and after the position in the width direction is adjusted, the engaging piece 74 of the pusher 71 is introduced into a space between the two locking fins 23 and 23 of the feeder 20.

A sequential operation of the pusher 71 is executed by an elastic restoration force of the tension spring 84 of the driving unit 70 through the traction string 80 fixed to the pusher 71.

Figure 11:
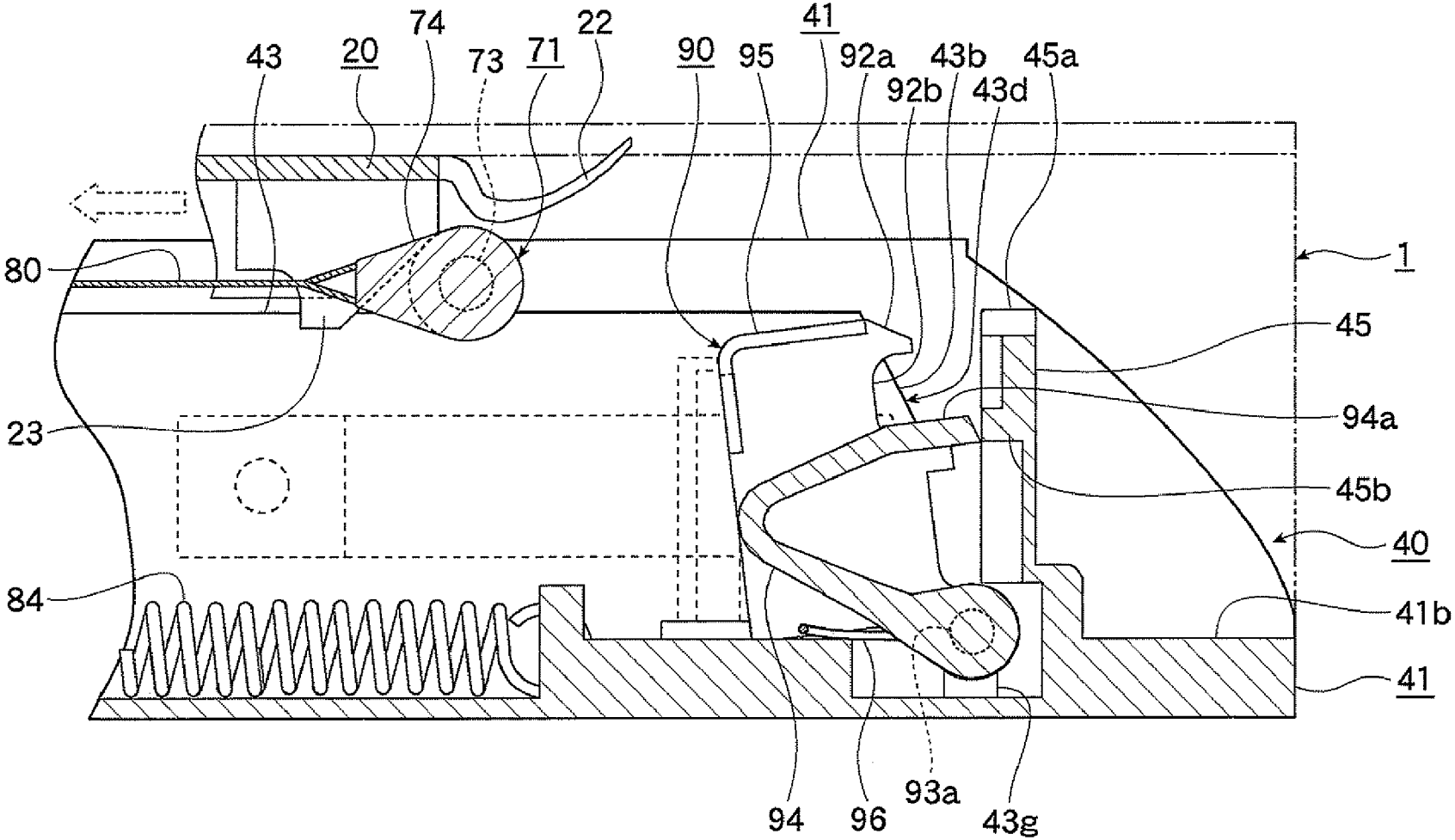
FIG. 11 is an enlarged front view of major portions showing a condition of the cassette type stapler of the embodiment in which the staple storage cassette is inserted, enabling the staple to be driven out.

FIG. 11 is an enlarged front view of major portions showing a condition of the cassette loading magazine in which the staple storage cassette is inserted, enabling the staple to be driven out.

At a position in which the front end of the staple storage cassette 1 when loaded on the cassette loading magazine keeps contact with the front wall section 41*c* of the magazine body 41, the front end portion of the abutting engaging piece 94 of the pusher holding unit 90 abuts the front surface of the wall portion of the engaging convex portion 45*b* of the guide wall section 45*a*. Thus, the abutting engaging piece 94 is released from the bottom surface portion of the engaging concave portion 45*b* and consequently, when the staple storage cassette 1 is pulled out of the cassette loading magazine 40, the supporting shaft 73 of the pusher 71 is enabled to invade into the engaging concave portions 92*b* of the pusher holding unit 90 easily.

Next, an operation of pulling out the staple storage cassette loaded on the cassette loading magazine will be described.

Figure 12:
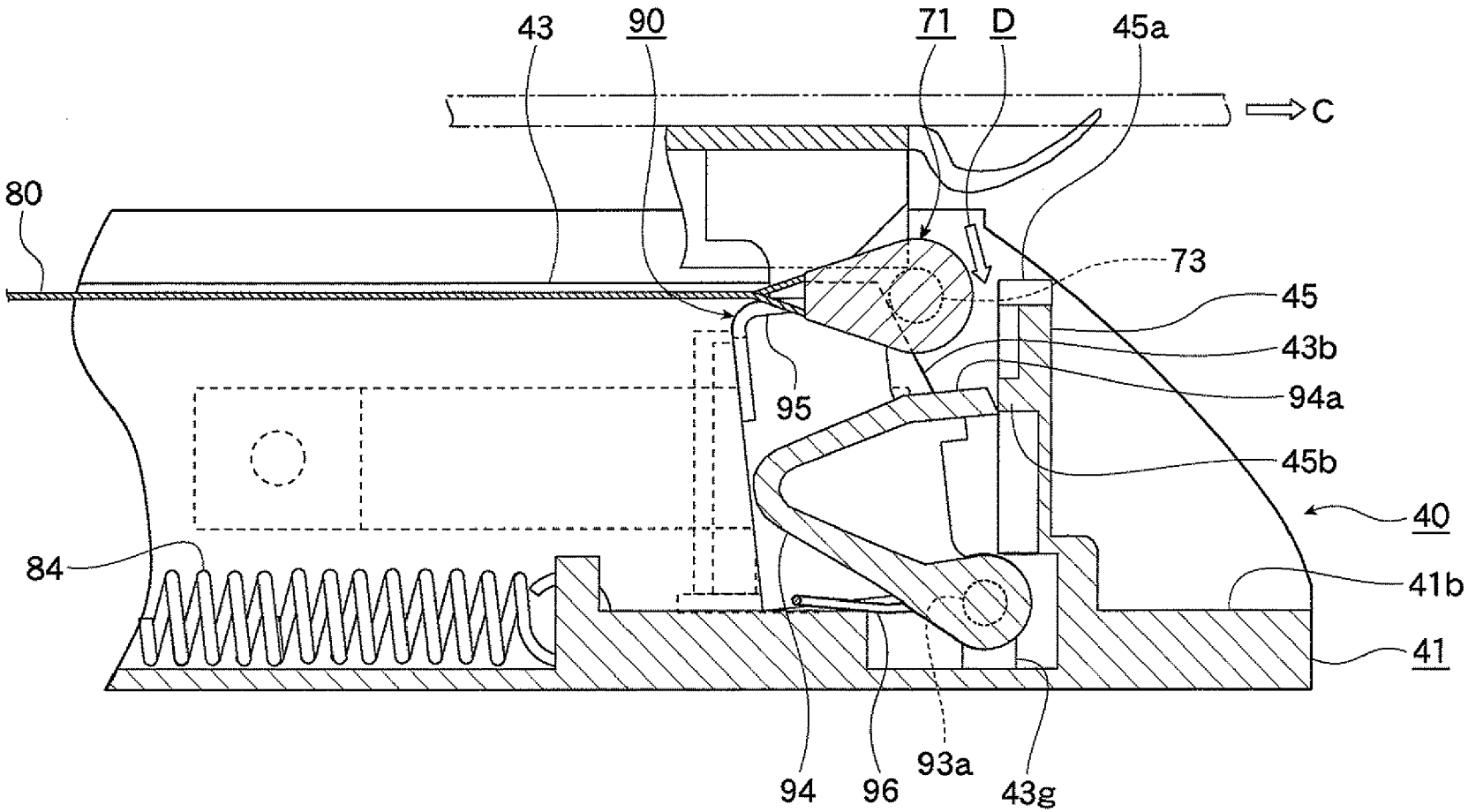
FIG. 12 is an enlarged front view of major portions showing a condition just before the staple storage cassette is pulled out from the cassette type stapler of the embodiment.

FIG. 12 is an enlarged front view of major portions showing a condition just before the staple storage cassette is pulled out.

When the staple storage cassette 1 is pulled out of the cassette loading magazine 40 in the direction of an arrow C against a tension of the tension spring 84 of the driving unit 70, the pusher 71 which keeps contact with the locking fins 23 of the feeder 20 is drawn and moved backward and the pusher body 72 comes into contact with the pusher holding unit 90, whereby pushing up the horizontal surface of the sensor piece 95. When it is pulled further, the pusher 71 slides down in the direction of an arrow D along the inclining surfaces 43*b* of the two rail guide plates 43, 43 and the supporting shaft 73 of the pusher 71 passes the inclining surfaces 92*a* of the top end rear portion of the pusher holding unit 90. As a consequence, it is inclined slightly in counterclockwise direction around the supporting shaft 93*a* of the pusher holding unit 90 by a pulling tension of the tension spring 84 of the driving unit 70. Subsequently, the pusher body 72 of the pusher 71 pushes down the abutting engaging piece 94 and the supporting shafts 73 of the pusher 71 engage the engaging concave portions 92*b* of the pusher holding unit 90, so that they stay in the bearing portions 43*d* of the two guide rail plates 43, 43.

At this time, the flat portion 94*a* of the front end of the abutting engaging piece 94 of the pusher holding unit 90 is hooked by the bottom surface portion of the engaging convex portion 45*b* of the guide wall section 45*a*, so that the pusher holding unit 90 is fixed in an upright condition by an urging force in the clockwise direction of the lower wire spring 96 mounted on the connecting portion 93. At this time, the engaging pieces 62 of the second lock spring 60 invade into a lower surface of the pusher holding unit 90, returning to the original state shown in FIG. 9.

As the cassette type stapler 110 having the cassette loading magazine 40 in which the staple storage cassette 1 described above can be loaded, the cassette loading magazine 40 is supported on a substantially flat base member 111 having an anvil 112 containing a guide groove 112*a* for guiding for bending of the bottom end portion of the staple 11 penetrating paper or the like such that it can be moved vertically through pantograph members 113 having magazine supporting springs (not shown).

A spring 117 is interposed between a base member 111 and an operation handle 115 and the operation handle 115 is journaled by a supporting shaft 114 of the cassette loading magazine 40 rotatably.

A pair of bearing plates 119, 119 are provided below the central portion of the operation handle 115 and a bearing elongated hole 120 is formed in this bearing plate 119. A drive shaft 121 projecting outward from the top end portion of the staple pushing blade 118 for punching down the staple 11 at the head of the staple assembly 10 within the staple storage cassette 1 is inserted into the bearing elongated hole 120. Consequently, when the operation handle 115 is pushed down, it descends vertically by an action of the pantograph member 113 until the cassette loading magazine 40 comes into contact with the surface of papers to be bound and after that, the free end portion of the operation handle 115 is rotated around the supporting shaft 114 in counterclockwise direction in FIG. 13.

Figure 13:
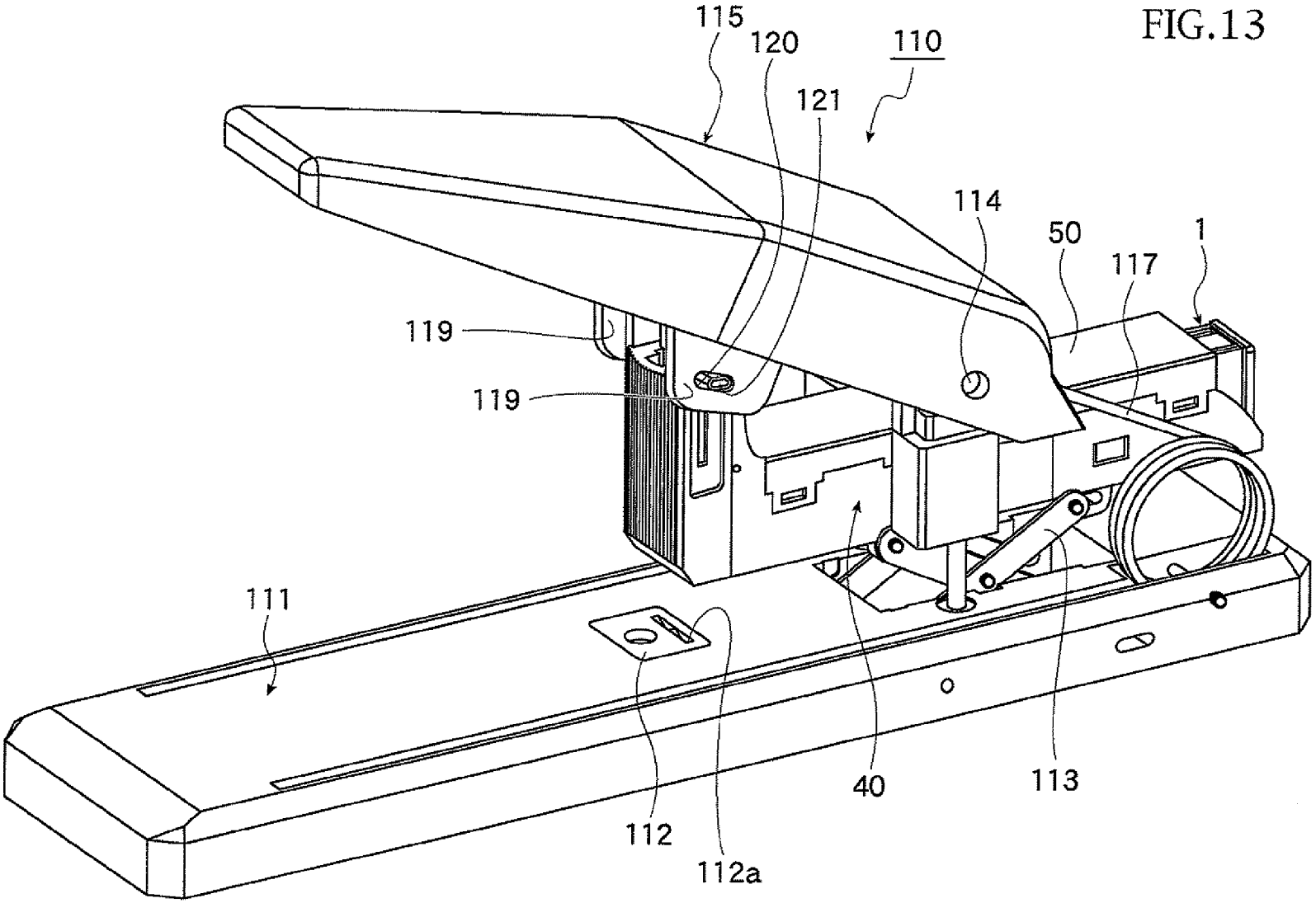
FIG. 13 is a perspective view showing the cassette type stapler of the embodiment.
Figure 14:
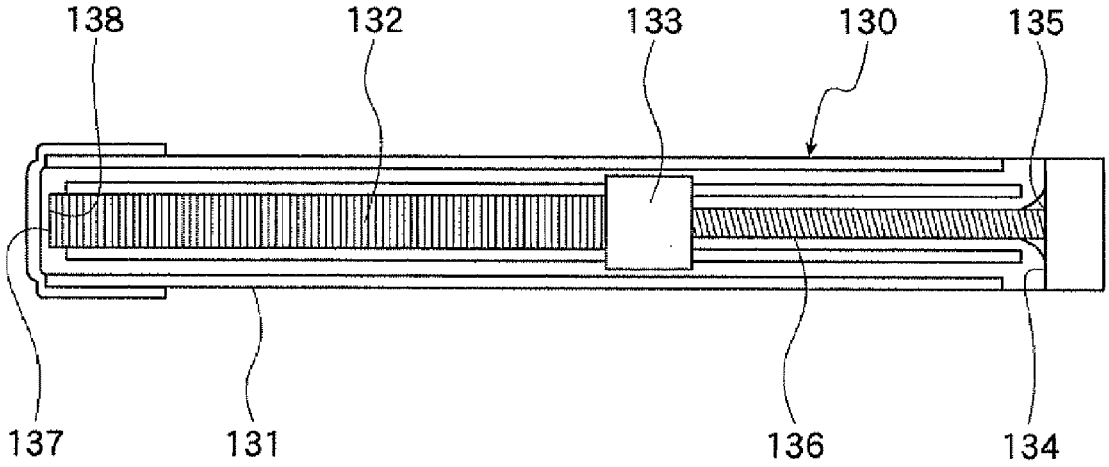
FIG. 14 is a plan view of a conventional staple storage cassette.
Figure 15:
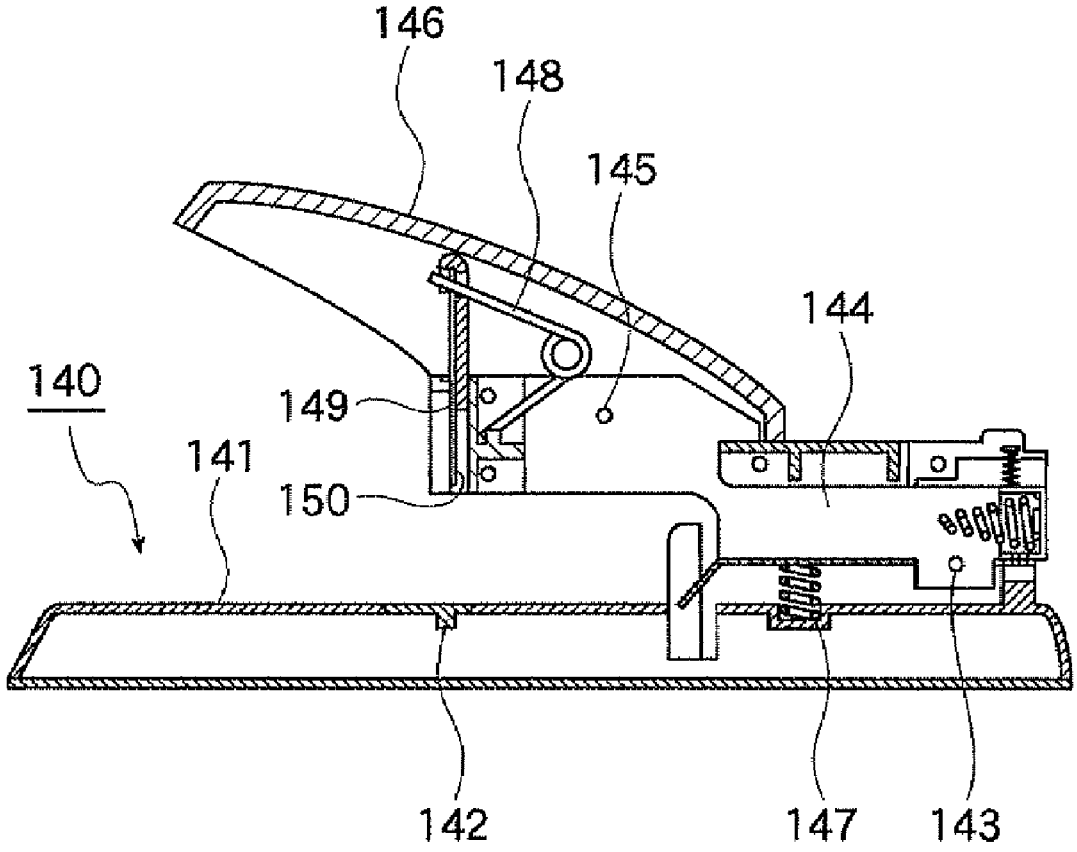
FIG. 15 is a longitudinal sectional view of the cassette type stapler using the conventional staple storage cassette.

Accompanied by a rotation of the operation handle 115, the bearing elongated hole 120 in the bearing plate 119 of the operation handle 115 is rotated in counterclockwise direction in FIG. 13 around the supporting shaft 114, so that the drive shaft 121 of the staple pushing blade 118 inserted in the bearing elongated hole 120 is pushed down. Because as described above, the staple pushing blade 118 is supported such that it is capable of moving vertically within the blade guide groove provided on the front wall section 41*c* of the cassette loading magazine 40, the staple pushing blade 118 can drive the first staple 11 from the staple storage cassette 1 so that it penetrates papers or the like when it passes through the blade guide hole 41*d*. The foot portion of the staple 11 after penetrating papers or the like is bent inward by the guide groove 12*a* of the anvil 113 of the base member 11 so as to complete binding work of papers.

Because as described above, the driving unit 70 for driving the feeder 20 by pressing the staple assembly 10 while making contact with the rear end portion of the staple assembly 10 within the staple storage cassette 1 is provided within the cassette loading magazine 40 (see FIGS. 4, 7), the staples 11 can be driven out continuously.

According to the embodiment of the cassette type stapler of the present invention, as the driving unit 70 which advances the feeder 20, the pusher 71 which makes contact with the feeder 20, the traction string 80 which is contacted with the pusher 71 and a pulley mechanism which combines the fixed pulley 81 with the movable pulley 82 for determining a passage of the traction string 80 are employed and the tension spring 84 which pulls the movable pulley 82 in the longitudinal direction of the cassette loading magazine 40 is adopted as a driving source. Consequently, the driving unit 70 can be incorporated in a narrow space of the cassette loading magazine 40.

If the cassette loading magazine 40 is assumed to be of equal length, up to a last one of the staples 11 can be driven out by advancing the staple assembly 10 even if only the staple assembly 10 and the feeder 20 are incorporated in the staple storage cassette 1. As a result, the staple storage cassette 1 accommodating more staples 11 than a conventional staple storage cassette which incorporates a compression spring for advancing the staple assembly 10 and the feeder 20 can be used.

DESCRIPTION OF REFERENCE NUMERALS

1: staple storage cassette
2: cassette rail member
3: guide rail
10: staple assembly
11: staple
20: feeder
22: elastically engaged claw piece
23: locking fin
30: cassette cover member
30*g*: blade guide hole
31: engaging concave portion
40: cassette loading magazine
41: magazine body
41*c*: front wall section
41*d*: blade guide hole
42: magazine rail member
43: rail guide plate
43*a*: concave portion
43*b*: inclining surface
43*c*: through hole
43*d*: bearing portion
44: cassette insertion port
45: accommodating portion
45*a*: guide wall section
45*b*: engaging convex portion
50: magazine cover member
60: second lock spring
61: arm piece
62: engaging piece
63: releasing projection piece
70: driving unit
71: pusher
72: pusher body
73: supporting shaft
74: hooking piece
80: traction string
81*a*: first fixed pulley
81*b*: second fixed pulley
82: movable pulley
83: intermediating block
84: tension spring
85: first supporting shaft
86: second supporting shaft
90: pusher holding unit
91: lock member body
92: engaging piece
92*a*: inclining surface
92*b*: engaging concave portion
93*a*: supporting shaft
94: abutting engaging piece
94*a*: flat portion
95: sensor piece
96: lower wire spring
100: staple guide member
110: cassette type stapler
111: base member
112: anvil
113: pantograph member
114: supporting shaft
115: operation handle
116: magazine supporting spring
117: spring
118: staple pushing blade

The invention claimed is:

1. A staple storage cassette comprising:

a cassette rail member having a pair of guide rails disposed in parallel with a gap therebetween;

a staple assembly including a plurality of staples connected in succession, slidably installed on the cassette rail member;

a feeder which makes contact with a rear end portion of the staple assembly and slidably movable on the cassette rail member;

and a cassette cover member which covers at least both side surfaces and a top surface in the longitudinal direction and of the cassette rail member so as to form a passage into which the staple and the feeder are inserted, wherein the cassette cover member has a stopper for positioning a head position of the staple assembly at a front end portion thereof and a blade guide hole through which a staple pushing blade passes, the blade guide hole being located adjacent to the stopper, the feeder includes an elastically engaged claw piece, an engaging concave portion which engages the elastically engaged claw piece only in one direction is formed continuously in the longitudinal direction in the inner surface of the cassette cover member so as to allow the feeder to move only in a forward direction.

2. The staple storage cassette according to claim 1, wherein the cassette rail member and the cassette cover member are detachably integrated.

3. A cassette type stapler having a cassette loading magazine on which the staple storage cassette according to claim 2 is loaded, wherein the cassette loading magazine has a pusher which makes a contact with the rear end portion of the feeder after the staple storage cassette is loaded and a driving unit for moving the pusher toward the blade guide hole.

4. The cassette type stapler according to claim 3, wherein the driving unit includes:

a traction string one end of which is fixed to the pusher;

an elastic member which generates a traction force in the traction string attached to the cassette loading magazine; and an intermediating block for connecting the elastic member with the other end of the traction string, a first fixed pulley and a second fixed pulley are pivoted independently on a front portion of the cassette loading magazine, a movable pulley is pivoted by the intermediating block, the traction string is connected to the intermediating block through the first fixed pulley, the movable pulley and the second fixed pulley, and the traction force toward the blade guide hole is always applied to the pusher.

5. A cassette type stapler having a cassette loading magazine on which the staple storage cassette according to claim 1 is loaded, wherein the cassette loading magazine has a pusher which makes a contact with the rear end portion of the feeder after the staple storage cassette is loaded and a driving unit for moving the pusher toward the blade guide hole.

6. The cassette type stapler according to claim 5, wherein the driving unit includes:

a traction string one end of which is fixed to the pusher;

an elastic member which generates a traction force in the traction string attached to the cassette loading magazine; and an intermediating block for connecting the elastic member with the other end of the traction string, a first fixed pulley and a second fixed pulley are pivoted independently on a front portion of the cassette loading magazine, a movable pulley is pivoted by the intermediating block, the traction string is connected to the intermediating block through the first fixed pulley, the movable pulley and the second fixed pulley, and the traction force toward the blade guide hole is always applied to the pusher.

7. The cassette type stapler according to claim 6, further comprising a pusher holding unit in which when the staple storage cassette is pulled out and not loaded on the cassette loading magazine, the pusher is held at the rear end portion of the cassette loading magazine and when the staple storage cassette is loaded on the cassette loading magazine, holding of the pusher at the rear end portion of the cassette loading magazine is released.

8. The cassette type stapler according to claim 6, wherein a metallic staple guide member having a substantially U-shaped in transverse section is disposed at a front end portion of the cassette loading magazine and when the staple storage cassette is loaded on the cassette loading magazine, outer side surfaces of foot portions of at least a staple at the head of the staple assembly are guided by the opposing both side walls of the staple guide member so as to descend the staple.

9. The cassette type stapler according to claim 5, further comprising a pusher holding unit in which when the staple storage cassette is pulled out and not loaded on the cassette loading magazine, the pusher is held at the rear end portion of the cassette loading magazine and when the staple storage cassette is loaded on the cassette loading magazine, holding of the pusher at the rear end portion of the cassette loading magazine is released.

10. The cassette type stapler according to claim 9, wherein a metallic staple guide member having a substantially U-shaped in transverse section is disposed at a front end portion of the cassette loading magazine and when the staple storage cassette is loaded on the cassette loading magazine, outer side surfaces of foot portions of at least a staple at the head of the staple assembly are guided by the opposing both side walls of the staple guide member so as to descend the staple.

11. The cassette type stapler according to claim 5, wherein a metallic staple guide member having a substantially U-shaped in transverse section is disposed at a front end portion of the cassette loading magazine and when the staple storage cassette is loaded on the cassette loading magazine, outer side surfaces of foot portions of at least a staple at the head of the staple assembly are guided by the opposing both side walls of the staple guide member so as to descend the staple.

* * * * *